United States Patent [19]

Goleczka et al.

[11] Patent Number: 4,877,418

[45] Date of Patent: Oct. 31, 1989

[54] BRIQUETTE TREATMENT PROCESS

[75] Inventors: Joseph Goleczka, Cheltenham; Walter Harris; John Pringle, both of Tewkesbury, all of England

[73] Assignee: Coal Industry (Patents) Limited, United Kingdom

[21] Appl. No.: 117,559

[22] Filed: Nov. 6, 1987

[30] Foreign Application Priority Data

Dec. 2, 1986 [GB] United Kingdom ..... 8628733

[51] Int. Cl.[4] ..... C10L 10/00

[52] U.S. Cl. ..... 44/600; 44/602

[58] Field of Search ..... 44/6, 41, 600, 603, 44/542, 15 B, 602

[56] References Cited

U.S. PATENT DOCUMENTS

| | | | |
|---|---|---|---|
| 645,361 | 3/1900 | Hood | 44/6 |
| 2,436,146 | 2/1948 | Kleinicke | 44/6 |
| 2,854,347 | 9/1958 | Booth et al. | 44/6 |
| 3,395,002 | 7/1968 | Winnicki et al. | 44/6 |

FOREIGN PATENT DOCUMENTS

| | | | |
|---|---|---|---|
| 1915987 | 10/1969 | Fed. Rep. of Germany | 44/602 |
| 51993 | 3/1984 | Japan | 44/602 |
| 953778 | 4/1964 | United Kingdom | 44/602 |

OTHER PUBLICATIONS

Kirk-Othmer Encyclopedia of Chemical Technology 3rd Edition vol. 23-pp. 848 to 856 and 862 to 864, Wiley-Interscience.

*Primary Examiner*—Carl F. Dees

*Attorney, Agent, or Firm*—Stevens, Davis, Miller & Mosher

[57] ABSTRACT

Briquettes are tested to decrease efflorescence and to improve abrasion resistance and surface appearance, by dipping or spraying the formed briquettes with a solution of polyvinyl alcohol having a concentration greater than 1 part of polyvinyl alcohol to 250 parts of water.

5 Claims, No Drawings

BRIQUETTE TREATMENT PROCESS

This invention concerns a briquette treatment process; more especially it concerns a process for improving the appearance of solid fuel briquettes.

Solid fuel briquettes may exhibit various types of surface appearance which is considered unattractive by the consumer. For example, the briquettes may have a dull or powdery surface, loss of shape and loss of surface material caused by abrasion etc from handling during or after manufacture, weathering damage, efflorescence of salts which are inherent components of the briquette raw material or are formed during manufacture, causing the emergence some days after manufacture of light-coloured deposits on the surface, and other surface problems.

It has been proposed to treat solid fuel briquettes by spraying or dipping with various materials in order to improve their surface appearance or properties. For example, briquettes treated with aluminum compounds gain a silvery appearance and have improved resistance to water absorption; a gold colored briquette is marketed, made using paint residues; polyvinyl acetate dipping has been proposed to enhance briquette crushing strength. We have also tried dipping briquettes in solutions of sodium or potassium silicate, without any significant effect on efflorescence.

The present invention provides a briquette treatment process effective to prevent efflorescence comprising applying to the briquette after formation thereof, an aqueous solution of polyvinyl alcohol of a concentration of greater than 1 part of polyvinyl alcohol solids in 250 parts of water. Preferably, the briquette is at elevated temperature.

The polyvinyl alcohol is preferably that which is marketed as "medium viscosity". "Low viscosity" polyvinyl alcohol is preferably not used, since a coating formed therefrom tends to dissolve in cold water, and hence would be liable to degrade during open air stocking. Generally, the concentration of the solution need not exceed 1 part of solids to 50 parts of water, and a concentration of approximately 1:100 has been found especially satisfactory. The polyvinyl alcohol solids may be dissolved in hot water, eg at 80°–95° C. suitably in a bath through which steam is bubbled.

The solution may be applied dipping the briquettes, and/or by spraying over the briquettes e.g. by passing the briquettes on a conveyor through a bath of the solution. As has been mentioned above, it is preferred, in order to obtain maximum benefits from the treatment process of the invention, that the briquettes are at elevated temperature, and desirably the briquettes are treated with the solution as soon as practical after any high temperature curing or carbonization step in the formation of the briquettes providing there is no significant loss of strength. It is preferred that the briquettes are not water quenched or water sprayed before the treatment process with the solution. It is thought probable that treating the briquettes when hot tends to draw the solution into the internal pores of the briquette, and therefore, depending on circumstances, a heating step may usefully be incorporated eg. to 100° C. or above, if the briquette forming process is carried out effectively "cold". It will be appreciated that a bath of the solution, or recycled spray solution, will be heated by contact with hot briquettes.

The briquettes after treatment may, if desired, have additional treatments such as water spraying or dipping, and/or other treatments to improve surface finish, color, consumer appeal or mechanical properties.

It has been found that the process of the invention not only prevents efflorescence but in its preferred embodiments improves the surface cohesion and resistance to abrasion of the treated briquettes, provides an attractive surface sheen, and improved handling properties resulting in less breakage and decreased soiling for consumers. Additionally, it has been observed that the treated briquettes exhibit a substantially stabilized moisture content, causing relatively little weight increase when the briquettes are exposed to precipitation during outdoor stocking, or to water spraying. The briquettes may exhibit some loss of moisture during hot dry spells, but this may be less than from untreated briquettes.

The briquettes to be treated may be any form of agglomerated solid fuel eg. formed by conventional roll presses, ring roll presses die presses and rotary table presses, as well as agglomerates formed by extrusion or pelletizing. The solid fuel is preferably a coal, which may be any bituminous or non-bituminous coal, including naturally occurring coals having low smoke emissions such as anthracite, coals treated to reduce their smoke emissions for example by mild oxidation or pyrolysis, low rank bituminous or non-bituminous coals and coal blends. There are many briquetting processes in use or which have been proposed; the actual briquetting process selected is not critical to the present invention. However, the process of the invention may be advantageously applied to the process described in GB No. 2,187,754A, and which preferably incorporates a high temperature curing step.

The invention will now be described by way of exmaple only.

EXAMPLE 1

Briquettes were prepared according to the process of our specification GB 2,187,754A, using a binder of molasses, 1% phosphoric acid and 1% haematite. The briquettes ere cured at 250° C. and subsequently quenched directly in water and allowed to dry naturally by exposure to the atmosphere 90% of the briquettes developed a white crystalline deposit which covered more than half of their surface, whilst only 1% of the briquettes showed less than 15% coverage by the deposit.

When the hot briquettes were quenched in a solution of 1 part by weight of "Mowiol" 28/99 commercial medium-viscosity polyvinyl alcohol to 100 parts of water, only 2% of the briquettes developed deposits covering more than half the surface, and 83% of the briquettes showed less than 15% coverage. The proportion of briquettes showing less than 15% of deposits coverage was increased to 100% when the concentration of the polyvinyl alcohol solution was raised to 1 part "Mowiol" 28/99 to 50 parts of water.

EXAMPLE 2

The procedure of Example 1 was repeated, but utilizing a quenching solution of 1 part "Mowiol" 28/99 to 250 parts of water. 80% of the briquettes developed deposits over more than half their surface, and only 1% of the briquettes were observed with less than 15% surface coverage.

EXAMPLE 3

The hot briquettes prepared as described in Example 1, were quenched in water for 3 minutes and were then dipped in a solution containing 1 part by weight of "Mowiol" 28/99 to 100 parts of water. 5% of the briquettes became more than half covered with deposits and 15% of the briquettes showed less than 15% coverage.

When the solution strength was increased to 1 part "Mowiol" to 50 parts of water, and the above procedure repeated, 1% of the briquettes developed deposits over more than half their surface, and 49% showed less than 15% surface coverage.

EXAMPLE 4

Starch-bound 25 mm anthracite pellets at 120° C. were dipped for 3 minutes in a solution of 1 part "Mowiol" 28/99 to 100 parts of water, then allowed to drain for 15 minutes. After 4 days of storage in the dry, the product was compared with pellets which had been treated similarly except for dipping in water rather than the polyvinyl alcohol solution. The following improvements were noted (the pellets treated according to the invention being listed first):

(a) an increase in crushing strength, 114 kg compared to 70 kg;

(b) an improved Cochrane abrasion index, 83% compared to 72%;

(c) a 30% reduction in surface dustiness, and (d) an improvement in crushing strength after immersion in water for 24 hours, 24 kg compared to 7 kg.

EXAMPLE 5

Binderless char briquettes of 50 mm diameter, at 180° C., were quenched for 5 minutes in the same solution as in Example 4, then allowed to drain for 15 minutes. After 4 days storage in the dry, the product was compared with briquettes which had been treated similarly except that they were quenched in water instead of the solution.

The following improvements were noted (the briquettes treated according to the invention being listed first):

(a) an increase in crushing strength, 151 kg compared to 134 kg;

(b) an improvement in Cochrane abrasion index, 53% compared to 49% and (c) a 50% reduction in surface dustiness.

We claim:

1. A process for the reduction of the efflorescence in a formed and shaped coal briquettes, comprising:

applying to the briquettes after formation thereof an aqueous solution of a medium viscosity polyvinyl alcohol of a concentration of greater than 0.4 and up to 2% of polyvinyl alcohol solids by weight.

2. A process as claimed in claim 1, wherein the briquette is at an elevated temperature when treated with the soulution.

3. A process as claimed in claim 1, wherein the concentration of the solution is approximately one part of polyvinyl alcohol solids in 100 parts of water.

4. A process as claimed in claim 1, wherein the briquettes are dipped in the solution.

5. A process as claimed in claim 1, wherein the briquettes are produced by briquetting a fine coal with a binder comprising a molasses and an inorganic hardening agent.

* * * * *